US009836002B2

(12) United States Patent
Matsuo

(10) Patent No.: US 9,836,002 B2
(45) Date of Patent: Dec. 5, 2017

(54) IMAGE FORMING APPARATUS WITH SELECTABLE DISABLING OF FIXING OPERATION

(71) Applicant: Konica Minolta, Inc., Chiyoda-ku, Tokyo (JP)

(72) Inventor: Masahiro Matsuo, Kokubunji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/133,705

(22) Filed: Apr. 20, 2016

(65) Prior Publication Data

US 2016/0313681 A1 Oct. 27, 2016

(30) Foreign Application Priority Data

Apr. 27, 2015 (JP) ..... 2015-090076

(51) Int. Cl.
*G03G 15/00* (2006.01)
*G03G 15/20* (2006.01)

(52) U.S. Cl.
CPC ..... *G03G 15/652* (2013.01); *G03G 15/205* (2013.01); *G03G 15/2039* (2013.01); (Continued)

(58) Field of Classification Search
CPC ..... G03G 15/2035; G03G 15/205; G03G 15/2071; G03G 15/5012; G03G 15/5029; G03G 15/6591; G03G 15/70; G03G 2215/00371; G03G 2215/00455; G03G 2215/00493; G03G 2215/00603; G03G 2215/00721; G03G 2215/00746; (Continued)

(56) References Cited

U.S. PATENT DOCUMENTS 5,109,255 A * 4/1992 Nishikawa ..... B41J 15/06 219/216
5,432,593 A * 7/1995 Nishikawa ..... G03G 15/2064 399/328

(Continued)

FOREIGN PATENT DOCUMENTS

JP 2005202166 A * 7/2005
JP 2011095692 A 5/2011
JP 2014164149 A * 9/2014

*Primary Examiner* — Robert Beatty
(74) *Attorney, Agent, or Firm* — Cantor Colburn LLP

(57) ABSTRACT

An image forming apparatus that forms an image on a long paper sheet conveyed along a conveyance path extending from a paper feeding side to a paper discharging side includes: an image forming unit configured to transfer a toner image onto the long paper sheet; a fixing unit configured to fix the toner image onto the long paper sheet; a paper existence determining unit configured to determine whether the long paper sheet exists along the conveyance path; a temperature determining unit configured to determine whether a fixing temperature of the fixing unit is equal to or lower than a predetermined temperature when the paper existence determining unit determines that the long paper sheet exists along the conveyance path; and a state setting unit configured to disable a fixing operation of the fixing unit when the temperature determining unit determines that the fixing temperature is higher than the predetermined temperature.

9 Claims, 10 Drawing Sheets

(52) U.S. Cl.
CPC ..... *G03G 15/2046* (2013.01); *G03G 15/5012* (2013.01); *G03G 15/70* (2013.01); *G03G 2215/00455* (2013.01); *G03G 2215/00493* (2013.01); *G03G 2215/00603* (2013.01)

(58) Field of Classification Search
CPC . G03G 2215/00751; G03G 2221/1672; G03G 2221/1675
USPC ..... 399/18, 33, 384, 389
See application file for complete search history.

(56) References Cited

U.S. PATENT DOCUMENTS

| | | | | |
|---|---|---|---|---|
| 5,555,075 | A * | 9/1996 | Fukano | G03G 15/2039 219/216 |
| 6,728,497 | B2 * | 4/2004 | Masuda | G03G 15/2003 399/33 |
| 9,316,967 | B2 * | 4/2016 | Fukai | G03G 15/2032 |
| 9,323,188 | B2 * | 4/2016 | Matsumoto | G03G 15/2042 |
| 9,329,541 | B2 * | 5/2016 | Matsuo | G03G 15/2039 |
| 9,395,664 | B2 * | 7/2016 | Fukai | G03G 15/6564 |
| 2013/0279922 | A1 * | 10/2013 | Ruiz | G03G 15/2035 399/21 |
| 2015/0277323 | A1 * | 10/2015 | Yamazaki | G03G 15/5012 399/21 |
| 2015/0355584 | A1 * | 12/2015 | Ishikawa | G03G 15/6517 399/69 |
| 2016/0124358 | A1 * | 5/2016 | Yamaguchi | G03G 15/2032 399/68 |
| 2016/0259277 | A1 * | 9/2016 | Umeno | G03G 15/2028 |
| 2016/0357136 | A1 * | 12/2016 | Sasami | G03G 15/2039 |

* cited by examiner

IMAGE FORMING APPARATUS WITH SELECTABLE DISABLING OF FIXING OPERATION

The entire disclosure of Japanese Patent Application No. 2015-090076 filed on Apr. 27, 2015 including description, claims, drawings, and abstract are incorporated herein by reference in its entirety.

BACKGROUND OF THE INVENTION

Field of the Invention

The present invention relates to an image forming apparatus.

Description of the Related Art

There have been image forming apparatuses that put a fixing roller and a pressure roller into a separated state when the power for heating the fixing roller is turned off (see JP 2011-95692 A, for example).

By the technology disclosed in JP 2011-95692 A, when the heating of the fixing roller is stopped, the fixing roller and the pressure roller are separated from each other, so that a quick recovery to a normal state is possible even in a case where the fixing unit has abruptly stopped due to a jam or the like during conveyance of paper, and the fixing temperature of the fixing roller has risen.

However, the technology disclosed in JP 2011-95692 A relates to a system configuration in which an image forming apparatus does not store any record of problems that have occurred. When the image forming apparatus is restarted after the power is turned off, the record of the past states of the respective components in the image forming apparatus is erased. For example, in a case where the power is turned off after a jam or a service call (SC), and the image forming apparatus is then restarted, or where the power is abruptly turned off due to a blackout or the like, and the image forming apparatus is then restarted, no record of the past states of the respective components in the image forming apparatus is stored, and therefore, the restart is regarded as a recovery to a normal state.

In an image forming apparatus that forms an image on roll paper, even if such a restart is regarded as a recovery to a normal state, it is necessary to introduce roll paper into the image forming apparatus main unit including the fixing unit before a printing operation is performed. In such an image forming apparatus, a normal state is a state where roll paper exists along the conveyance path in the machine at the time when the power is turned on, or is a state where any roll paper does not exist in the conveyance path in the machine at the time when the power is turned on.

However, a state where part of a long paper sheet remains in the conveyance path in the machine when the power is turned on is not a normal state. Therefore, a problem might occur, if a recovery to a normal state is determined regardless of the state of the roll paper in the conveyance path in the machine.

If the fixing temperature of the fixing unit is high, and the roll paper is film-type paper made of polypropylene (PP) or polyethylene terephthalate (PET), the roll paper deforms and melts readily, compared with conventional paper. In view of this, roll paper left in the fixing unit while the fixing temperature is high might deform and melt. If roll paper is conveyed in such a state, various problems might occur.

For example, roll paper being conveyed might leave scratches on the fixing unit. If roll paper melts with heat, the roll paper not only winds around the fixing unit but also causes a problem in winding up the roll paper.

SUMMARY OF THE INVENTION

The present invention has been made to solve the above problems, and an object thereof is to provide an image forming apparatus that can determine whether to allow printing in accordance with the conditions inside the machine.

To achieve the abovementioned object, according to an aspect, an image forming apparatus that forms an image on a long paper sheet conveyed along a conveyance path extending from a paper feeding side to a paper discharging side, the image forming apparatus reflecting one aspect of the present invention comprises: an image forming unit configured to transfer a toner image onto the long paper sheet; a fixing unit configured to fix the toner image transferred by the image forming unit onto the long paper sheet; a paper existence determining unit configured to determine whether the long paper sheet exists along the conveyance path when power is turned on; a temperature determining unit configured to determine whether a fixing temperature of the fixing unit is equal to or lower than a predetermined temperature when the paper existence determining unit determines that the long paper sheet exists along the conveyance path; and a state setting unit configured to disable a fixing operation of the fixing unit when the temperature determining unit determines that the fixing temperature is higher than the predetermined temperature.

With this image forming apparatus, the operation of the fixing unit is controlled in accordance with the position and the state of the long paper sheet, and the fixing temperature of the fixing unit. Thus, printing can be allowed or prohibited in accordance with the conditions inside the machine after the power is turned on.

The image forming apparatus further preferably comprises: a display unit; and a display control unit configured to control the display unit, and when the temperature determining unit determines that the fixing temperature is higher than the predetermined temperature, the display control unit preferably causes the display unit to indicate that the long paper sheet is to be removed from the conveyance path.

With this image forming apparatus, the possibility of overlooking heating of the long paper sheet is lowered, and a problem due to an increase in the temperature of the fixing unit can be avoided.

The fixing unit preferably includes a fixing roller and a pressure roller, and the image forming apparatus further preferably comprises: a state determining unit configured to determine whether the fixing roller and the pressure roller are in a separated state, and whether the fixing roller and the pressure roller are in a pressure-bonded state, when the state setting unit disables the fixing operation of the fixing unit; and a pressure bonding/separating unit configured to separate the pressure roller from the fixing roller when the state determining unit determines that the fixing roller and the pressure roller are in the pressure-bonded state.

With this image forming apparatus, the long paper sheet is not brought into contact with the fixing roller and the pressure roller. Thus, the long paper sheet can be prevented from deforming and melting with heat, even if the long paper sheet is of a film type.

When the temperature determining unit determines that the fixing temperature is equal to or lower than the predetermined temperature, the state setting unit preferably enables the fixing operation of the fixing unit.

With this image forming apparatus, a print enabled state is set in accordance with the conditions inside the machine. Thus, the image forming apparatus can transit from an abnormal suspension state to a normal recovery state at an appropriate time.

The image forming apparatus further preferably comprises: a conveyance control unit configured to control conveyance of the long paper sheet; a velocity sensing unit configured to sense a velocity of conveyance of the long paper sheet being conveyed under the control of the conveyance control unit; and a problem determining unit configured to determine that the long paper sheet remains abnormally still in the conveyance path when the conveyance velocity sensed by the velocity sensing unit is equal to or lower than a predetermined velocity while the long paper sheet is being conveyed under the control of the conveyance control unit.

With this image forming apparatus, a check is made to determine whether the long paper sheet remains abnormally still in the conveyance path in accordance with the velocity of conveyance of the long paper sheet. Thus, abnormal conveyance of the long paper sheet can be detected with a simple structure.

The image forming apparatus further preferably comprises a temperature changing unit configured to change the predetermined temperature in accordance with a paper type of the long paper sheet.

With this image forming apparatus, the fixing temperature of the fixing unit is determined by taking into account the type of the long paper sheet, so that printing can be allowed or prohibited in accordance with the type of the long paper sheet. Thus, the conditions inside the machine after the power is turned on can be accurately managed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Figure 1:
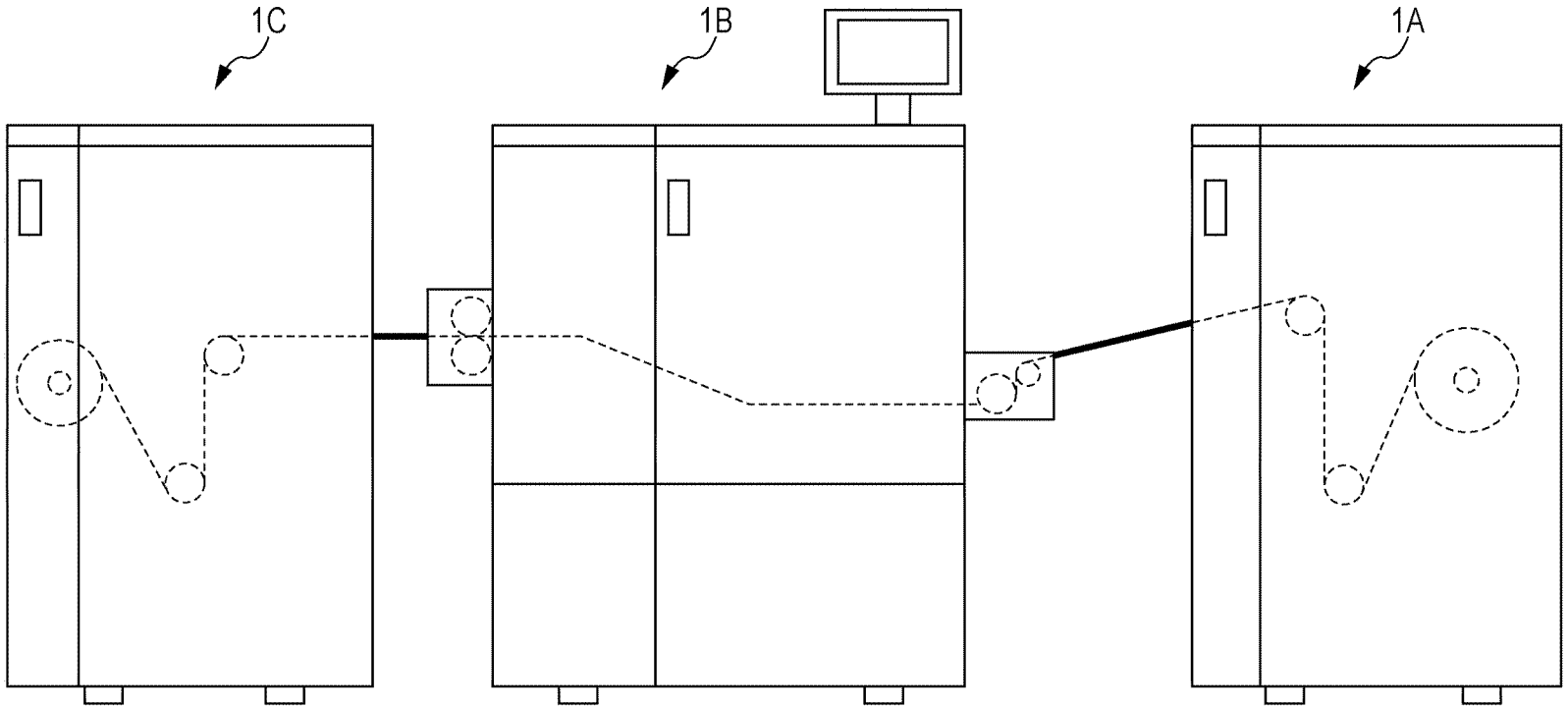
FIG. 1 shows an example of an image forming apparatus 1 according to an embodiment.

FIG. 1 shows an example of an image forming apparatus 1 according to this embodiment. As shown in FIG. 1, the image forming apparatus 1 includes a sheet feeder 1A, an image forming apparatus main unit 1B, and a winder 1C.

The sheet feeder 1A stores a long paper sheet such as roll paper or continuous paper. The sheet feeder 1A supplies the long paper sheet to the image forming apparatus main unit 1B in accordance with an instruction from the image forming apparatus main unit 1B. As will be described later in detail, the image forming apparatus main unit 1B forms an image on the long paper sheet supplied from the sheet feeder 1A. The winder 1C winds up the long paper sheet discharged from the image forming apparatus main unit 1B. The long paper sheet wound up by the winder 1C has an image formed thereon by the image forming apparatus main unit 1B.

Figure 2:
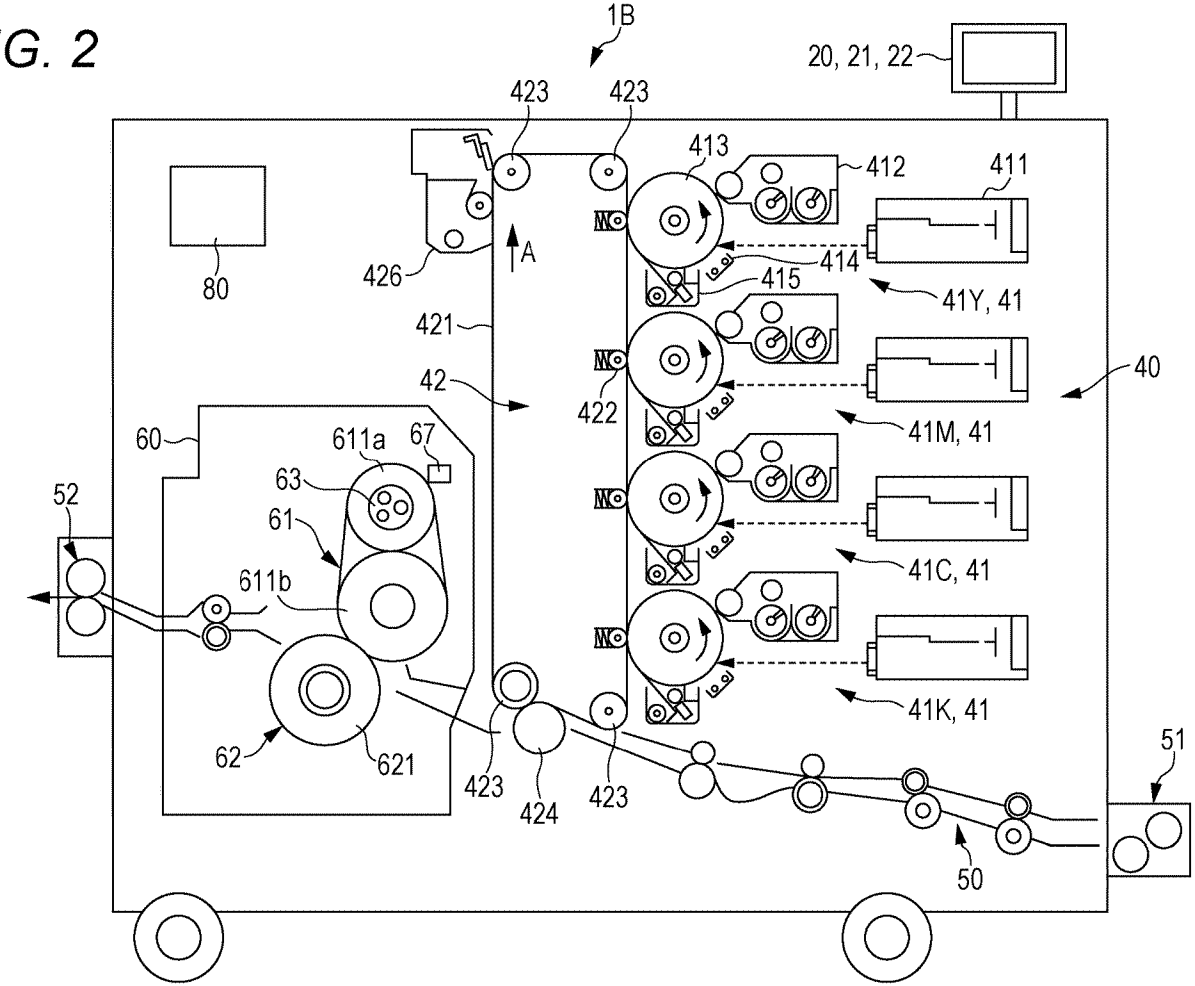
FIG. 2 is a diagram showing an example structure of an entire image forming apparatus main unit.
Figure 3:
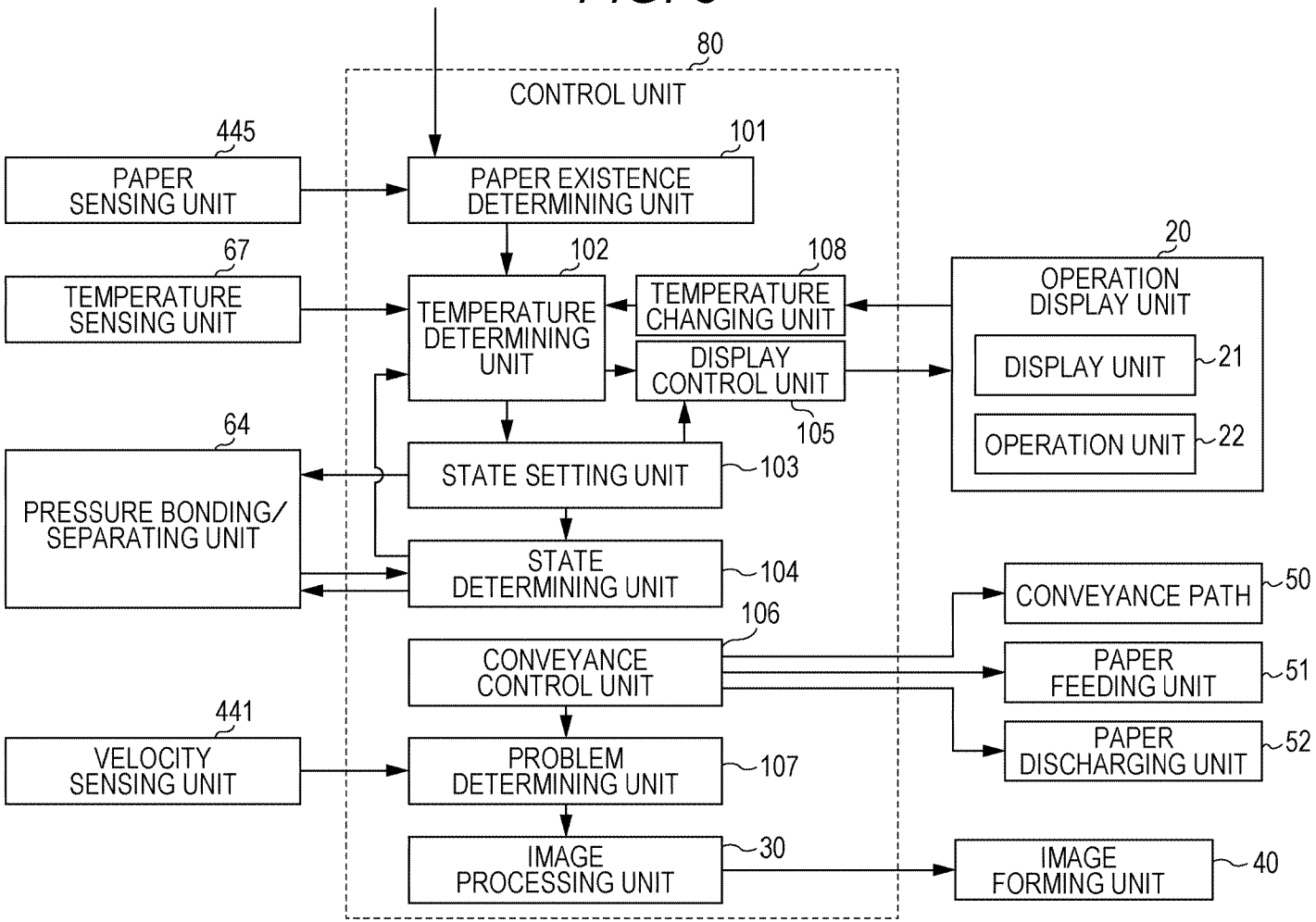
FIG. 3 is a block diagram showing an example functional structure of the image forming apparatus main unit.

FIG. 2 is a diagram showing an example structure of the entire image forming apparatus main unit 1B. FIG. 3 is a block diagram showing an example functional structure of the image forming apparatus main unit 1B.

As shown in FIGS. 2 and 3, the image forming apparatus main unit 1B is a color image forming apparatus of an intermediate transfer type that uses an electrophotographic process technology. In the image forming apparatus main unit 1B, photosensitive drums 413 corresponding to the four colors of yellow (Y), magenta (M), cyan (C), and black (K) are arranged in series in the conveying direction of an intermediate transfer belt 421 (or in the vertical direction). The image forming apparatus main unit 1B utilizes a vertical tandem method for sequentially transferring toner images in the respective colors onto the intermediate transfer belt 421.

Specifically, the image forming apparatus main unit 1B performs primary transfer to transfer toner images in the respective colors of Y, M, C, and K formed on the photosensitive drums 413, onto the intermediate transfer belt 421. After superimposing the toner images in the four colors on one another on the intermediate transfer belt 421, the image forming apparatus main unit 1B performs secondary transfer to transfer the toner images onto the long paper sheet, to form an image on the long paper sheet.

As shown in FIGS. 2 and 3, the image forming apparatus main unit 1B includes an operation display unit 20, an image forming unit 40, a conveyance path 50, a paper feeding unit 51, a paper discharging unit 52, a fixing unit 60, a heating unit 63, a temperature sensing unit 67, a pressure bonding/separating unit 64, a control unit 80, a velocity sensing unit 441, and a paper sensing unit 445. The control unit 80 includes an image processing unit 30.

The control unit 80 is formed mainly with a CPU, a ROM, a RAM, and an input/output interface (which are not shown in the drawings). The CPU reads a program from the ROM or a storage unit (not shown) in accordance with the details of processing, and loads the program into the RAM. The control unit 80 operates in accordance with the loaded program, to control operations of the respective blocks of the image forming apparatus main unit 1B, the sheet feeder 1A, and the winder 1C.

That is, the control unit 80 controls operation of the image forming apparatus 1, and can be embodied by a microcomputer formed mainly with the CPU, the ROM, the RAM, and the input/output interface, which are not shown in the drawings.

Specifically, the control unit 80 executes a predetermined control program, to achieve functions including those of the image processing unit 30, a paper existence determining unit 101, a temperature determining unit 102, a state setting unit 103, a state determining unit 104, a display control unit 105, a conveyance control unit 106, a problem determining unit 107, and a temperature changing unit 108.

The respective functions of the image processing unit 30, the paper existence determining unit 101, the temperature determining unit 102, the state setting unit 103, the state determining unit 104, the display control unit 105, the conveyance control unit 106, the problem determining unit 107, and the temperature changing unit 108 will be described later in detail.

The operation display unit 20 is formed with a liquid crystal display (LCD) having a touch panel, for example, and functions as a display unit 21 and an operation unit 22.

The display unit 21 displays various operation screens, operating conditions of the respective functions, and the like, in accordance with display control signals that are input from the control unit 80. The operation unit 22 includes various operation keys such as the numeric keypad and the start key. The operation unit 22 accepts various input operations from users, and outputs operation signals to the control unit 80. A user can set desired image quality by operating the operation display unit 20. A user can also perform setting related to image formation such as magnification setting, application setting, output setting, and paper setting, by operating the operation display unit 20. Further, a user can issue a paper conveyance instruction by operating the operation display unit 20.

The image processing unit 30 performs digital image processing on input image data in accordance with initial setting or user setting. For example, the image processing unit 30 performs tone correction based on tone correction data created as a tone correction table. The image processing unit 30 also performs various correction processes such as color correction and shading correction, a compression process, and the like, on input image data. The image forming unit 40 is controlled based on the image data subjected to those processes.

The image forming unit 40 includes image formation units 41 and an intermediate transfer unit 42 for forming images with respective color toners of the Y component, the M component, the C component, and the K component based on image data subjected to the respective processes at the image processing unit 30. The image forming unit 40 transfers the toner images onto the long paper sheet.

The image formation units 41 are formed with four image formation units 41Y, 41M, 41C, and 41K for the Y component, the M component, the C component, and the K component. Since the image formation units 41Y, 41M, 41C, and 41K have the same structure, like composing elements are denoted by like reference numerals, and explanation of them will not be repeated twice or more. For example, in FIG. 2, only the composing elements of the image formation unit 41Y for the Y component are denoted by reference numerals, but the composing elements of the other image formation units 41M, 41C, and 41K are not.

Each image formation unit 41 includes an exposing device 411, a developing device 412, a photosensitive drum 413, a charging device 414, a drum cleaning device 415, and the like.

The photosensitive drum 413 is a negatively-charged organic photo-conductor (OPC) formed by stacking an undercoat layer (UCL), a charge generation layer (CGL), and a charge transport layer (CTL) on the circumferential surface of a conductive cylinder made of aluminum (an aluminum element tube), for example.

The charge generation layer is formed with an organic semiconductor containing a charge generating material (phthalocyanine pigment, for example) dispersed in a resin binder (polycarbonate, for example), and generates a pair of positive charge and negative charge upon exposure by the exposing device 411.

The charge transport layer is formed by dispersing a hole transporting material (an electron donating nitrogen-containing compound) in a resin binder (a polycarbonate resin, for example), and transports the positive charge generated in the charge generation layer to the surface of the charge transport layer.

The charging device 414 is formed with a corona discharger such as a scorotron charger or a corotron charger. The charging device 414 performs corona discharge, to uniformly and negatively charge the surface of the photosensitive drum 413.

The exposing device 411 is formed with an LED print head that includes an LED array in which light-emitting diodes (LEDs) are linearly arranged, an LPH driving unit (a driver IC) for driving the respective LEDs, and a lens array that gathers light emitted from the LED array and forms an image on the photosensitive drum 413, for example. One LED of the LED array corresponds to one dot in an image. As the control unit 80 controls the LPH driving unit, a predetermined drive current flows into the LED array, and designated LEDs emit light.

The exposing device 411 illuminates the photosensitive drum 413 with light in accordance with an image of the corresponding color component. As the positive charge generated in the charge generation layer of the photosensitive drum 413 is transported to the surface of the charge transport layer, the surface charge (the negative charge) of the photosensitive drum 413 is neutralized. As a result, an electrostatic latent image of the corresponding color component is formed on the surface of the photosensitive drum 413 by virtue of a potential difference from the surrounding area.

The developing device 412 stores a developer of the corresponding color component (a two-component developer formed with toner and a magnetic carrier, for example). The developing device 412 applies the toner of the corresponding color component onto the surface of the photosensitive drum 413, to make the latent image visible and form a toner image. Specifically, a developing bias voltage is applied to the developer carrier (a developing roller), and the charged toner on the developer carrier moves onto and adhere to the exposed portion of the surface of the photosensitive drum 413 by virtue of a potential difference between the photosensitive drum 413 and the developer carrier.

The drum cleaning device 415 includes a drum cleaning blade that is slidably brought into contact with the surface of the photosensitive drum 413. The drum cleaning device 415 removes the toner remaining on the surface of the photosensitive drum 413 after the primary transfer.

The intermediate transfer unit 42 includes the intermediate transfer belt 421, primary transfer rollers 422, supporting rollers 423, a secondary transfer roller 424, and a belt cleaning device 426.

The intermediate transfer belt 421 is formed with an endless belt, and is stretched in the form of a loop by the supporting rollers 423. At least one of the supporting rollers 423 is a driving roller, and the other ones are following rollers. For example, a supporting roller 423 that is located on the downstream side of the primary transfer roller 422 for the K component in the belt moving direction is preferably the driving roller. As the driving roller rotates, the intermediate transfer belt 421 moves in the direction indicated by an arrow A at a constant speed.

The primary transfer rollers 422 are placed on the inner circumferential surface side of the intermediate transfer belt 421, facing the photosensitive drums 413 of the respective color components. As the primary transfer rollers 422 are pressed against the photosensitive drums 413 with the intermediate transfer belt 421 interposed in between, primary transfer nips for transferring toner images from the photosensitive drums 413 onto the intermediate transfer belt 421 are formed.

The secondary transfer roller 424 is located on the outer circumferential surface side of the intermediate transfer belt 421, facing one of the supporting rollers 423. The supporting roller 423 facing the intermediate transfer belt 421 is called the backup roller. As the secondary transfer roller 424 is pressed against the backup roller with the intermediate transfer belt 421 interposed in between, a secondary transfer nip for transferring the toner image from the intermediate transfer belt 421 onto the long paper sheet is formed.

When the intermediate transfer belt 421 passes through the primary transfer nips, the toner images on the photosensitive drums 413 are sequentially transferred onto the intermediate transfer belt 421 in an overlapping manner. Specifically, a primary transfer bias is applied to each primary transfer roller 422 to provide the back surface side, or the side in contact with the primary transfer rollers 422, of the intermediate transfer belt 421 with charge of the opposite polarity from that of the toner. In this manner, the toner images are electrostatically transferred onto the intermediate transfer belt 421.

When the long paper sheet passes through the secondary transfer nip, the toner image on the intermediate transfer belt 421 is transferred onto the long paper sheet. Specifically, a secondary transfer bias is applied to the secondary transfer roller 424 to provide the back surface side, or the side in contact with the secondary transfer roller 424, of the long paper sheet with charge of the opposite polarity from that of the toner. In this manner, the toner image is electrostatically transferred onto the long paper sheet. The long paper sheet having the toner image transferred thereonto is then conveyed toward the fixing unit 60.

The belt cleaning device 426 includes a belt cleaning blade that is slidably brought into contact with the surface of the intermediate transfer belt 421. The belt cleaning device 426 removes the toner remaining on the surface of the intermediate transfer belt 421 after the secondary transfer.

In the intermediate transfer unit 42, the secondary transfer roller 424 may be replaced with a structure having a secondary transfer belt (not shown) stretched in the form of a loop by the supporting rollers 423 including the secondary transfer roller 424, or with a secondary transfer belt unit.

The fixing unit 60 includes an upper fixing unit 61, a lower fixing unit 62, the heating unit 63, and the temperature sensing unit 67. The fixing unit 60 fixes the toner image transferred by the image forming unit 40 onto the long paper sheet. The upper fixing unit 61 includes fixing-surface side members that are provided on the fixing surface of the long paper sheet, or on the surface having the toner image formed thereon. The lower fixing unit 62 includes a back-surface side supporting member provided on the back surface of the long paper sheet, or on the surface on the opposite side from the fixing surface.

The upper fixing unit 61 includes a fixing roller 611*a* and a fixing roller 611*b* as the fixing-surface side members. A fixing belt is stretched in the form of a loop by the fixing roller 611*a* and the fixing roller 611*b*. The lower fixing unit 62 includes a pressure roller 621 as the back-surface side supporting member. The position of the pressure roller 621 is controlled so that the pressure roller 621 is put into a pressure-bonded state or a separated state with respect to the fixing roller 611*b*.

The heating unit 63 is placed inside or in the vicinity of a fixing-surface side member, and heats the fixing-surface side member. As the control unit 80 controls the output of the heating unit 63, the fixing-surface side member is heated, and the fixing temperature of the fixing unit 60 reaches a high enough temperature to fix the toner image. The temperature sensing unit 67 is placed near the fixing-surface side member, and senses the fixing temperature of the fixing unit 60. The control unit 80 controls the output of the heating unit 63 based on the result of the sensing performed by the temperature sensing unit 67.

The pressure bonding/separating unit 64 presses the back-surface side supporting member against a fixing-surface side member. Under the control of the control unit 80, the pressure bonding/separating unit 64 presses the back-surface side supporting member against the fixing-surface side member. That is, under the control of the control unit 80, the pressure roller 621 is pressed against the fixing roller 611*b*. As a result, a fixing nip that nips and conveys the long paper sheet is formed. A conveyed long paper sheet that has the toner image transferred thereonto by the secondary transfer and has been conveyed along the conveyance path 50 is heated and pressed when passing through the fixing nip. As a result, the toner image is fixed onto the long paper sheet. As will be described later in detail, the pressure bonding/separating unit 64 also separates the back-surface side supporting member from the fixing-surface side member under some conditions. The fixing roller 611*a* and the fixing roller 611*b* may also be hereinafter referred to collectively as the fixing rollers 611.

The paper feeding unit 51 guides the long paper sheet conveyed from the sheet feeder 1A into the conveyance path 50. The paper feeding unit 51 applies a predetermined load onto the long paper sheet in accordance with the type of the long paper sheet. With this, the long paper sheet is smoothly introduced into the conveyance path 50. The conveyance path 50 is a paper conveyance path that conveys the long paper sheet from the paper feeding unit 51 to the paper discharging unit 52. Using rollers, the conveyance path 50 conveys the long paper sheet introduced from the paper feeding unit 51 to the image forming unit 40, then to the fixing unit 60, and finally to the paper discharging unit 52. The paper discharging unit 52 guides the long paper sheet conveyed from the conveyance path 50 into the winder 1C. The paper discharging unit 52 will be described later in detail with reference to FIG. 6.

Next, an example functional structure of the image forming apparatus 1 is described. However, explanation of the functions of some of the above described components is not made herein. As shown in FIG. 3, the control unit 80 includes not only the image processing unit 30, but also the paper existence determining unit 101, the temperature determining unit 102, the state setting unit 103, the state determining unit 104, the display control unit 105, the conveyance control unit 106, the problem determining unit 107, and the temperature changing unit 108.

The paper existence determining unit 101 determines whether a long paper sheet exists along the conveyance path 50 when the power is turned on. Specifically, the paper existence determining unit 101 is activated when the power is turned on, and determines whether there is a long paper sheet inside the machine based on a result of sensing performed by the paper sensing unit 445, which will be described later with reference to FIGS. 7 through 9. A state where a long paper sheet exists inside the machine is a state where a long paper sheet exists from the inlet to the outlet of the printer in a continuous manner. For example, a long paper sheet exists from the paper feeding unit 51 to the paper discharging unit 52 without any gaps.

If the paper existence determining unit 101 determines that the long paper sheet exists along the conveyance path 50, the temperature determining unit 102 determines whether the fixing temperature of the fixing unit 60 is equal to or lower than a predetermined temperature. The predetermined temperature is determined based on the type of the long paper sheet, is lower than the fixing temperature during normal use, and should be set at a value to be held during standby. If the fixing temperature of the fixing unit 60 is equal to or lower than the predetermined temperature, there will be no problem. However, if the fixing temperature of the fixing unit 60 is neither equal to nor lower than the predetermined temperature, or is higher than the predetermined temperature, deformation or the like might occur depending on the type of the long paper sheet.

The state setting unit 103 disables the fixing operation of the fixing unit 60 if the temperature determining unit 102 determines that the fixing temperature is neither equal to nor lower than the predetermined temperature. That is, when the temperature determining unit 102 determines that the fixing temperature is higher than the predetermined temperature, the state setting unit 103 sets a print disabled state. In the print disabled state, the fixing unit 60 is prohibited from performing the fixing operation.

Specifically, in a structure with the mechanism that puts the fixing roller 611*b* and the pressure roller 621 into a pressure-bonded state or a separated state, the print disabled state is a state where the separated state is set, and the rotating operation for fixing is suspended. In a structure without the mechanism that puts the fixing roller 611*b* and the pressure roller 621 into a pressure-bonded state or a separated state, the print disabled state is a state where the rotating operation for fixing is suspended.

The state setting unit 103 enables the fixing operation of the fixing unit 60 if the temperature determining unit 102 determines that the fixing temperature is equal to or lower than the predetermined temperature. That is, when the temperature determining unit 102 determines that the fixing temperature is equal to or lower than the predetermined temperature, the state setting unit 103 sets a print enabled state. In the print enabled state, the fixing unit 60 is allowed to perform the fixing operation. The print enabled state is a state where the rotating operation for fixing can be started.

If the state setting unit 103 disables the fixing operation of the fixing unit 60, the state determining unit 104 determines whether the fixing roller 611*b* and the pressure roller 621 are in the separated state, or whether the fixing roller 611*b* and the pressure roller 621 are in the pressure-bonded state. If the state determining unit 104 determines that the fixing roller 611*b* and the pressure roller 621 are in the pressure-bonded state, the pressure bonding/separating unit 64 separates the pressure roller 621 from the fixing roller 611*b*.

The display control unit 105 controls the display unit 21. If the temperature determining unit 102 determines that the fixing temperature is neither equal to nor lower than the predetermined temperature, the display control unit 105 causes the display unit 21 to display a message to the effect that the long paper sheet should be removed from the conveyance path 50.

The conveyance control unit 106 controls the conveyance of the long paper sheet. Specifically, the conveyance control unit 106 performs control to convey the long paper sheet from the paper feeding unit 51 to the conveyance path 50, and then to the paper discharging unit 52. The conveyance control unit 106 guides the long paper sheet introduced from the sheet feeder 1A into the winder 1C through the inside of the machine.

In a case where the conveyance control unit 106 conveys the long paper sheet, the problem determining unit 107 determines that the long paper sheet remains abnormally still in the conveyance path 50 if the conveyance velocity sensed by the velocity sensing unit 441, which will be described later in detail, is equal to or lower than a predetermined velocity. That is, the problem determining unit 107 determines whether there is a jam in the machine based on the conveyance velocity.

A jam means a phenomenon in which a paper sheet being conveyed through predetermined mechanical components gets caught inside a mechanical component or between adjacent mechanical components in the image forming apparatus 1. When a jam occurs, the image forming operation of the image forming apparatus 1 is suspended normally.

The temperature changing unit 108 changes the predetermined temperature to be compared with the fixing temperature of the fixing unit 60 in accordance with the type of the long paper sheet. Specifically, the temperature changing unit 108 selects a temperature corresponding to an input in accordance with a correspondence table (not shown) of paper types of long paper sheets and temperatures. For example, when a user inputs the paper type of the long paper sheet to be used via the operation display unit 20, the predetermined temperature is changed in accordance with the input.

Next, the prerequisites for forming an image on a long paper sheet are described. As a preparation for printing, it is necessary to introduce the long paper sheet along the conveyance path 50 from the sheet feeder 1A to the winder 1C before the image forming unit 40 forms an image. This preparation for printing may be conducted automatically or manually.

After the above preparation for printing, the long paper sheet introduced to exist from the sheet feeder 1A to the winder 1C is conveyed when the image forming unit 40 forms an image. When the long paper sheet passes through the secondary transfer nip, the toner images on the intermediate transfer belt 421 are collectively transferred onto the fixing surface of the long paper sheet through the secondary transfer, and are subjected to a fixing process at the fixing unit 60. The long paper sheet having an image formed thereon is discharged to the outside of the machine by the paper discharging unit 52, and is wound up by the winder 1C.

When the image forming apparatus 1 is preparing for printing or in a standby state, the fixing temperature of the fixing unit 60 is preferably maintained at such a temperature as not to cause discoloration or deformation in the long paper sheet, and the long paper sheet is in a state where neither discoloration nor deformation will be caused. For example, the control unit 80 controls the fixing temperature of the fixing unit 60 by controlling the output of the heating unit 63 based on the temperature sensing unit 67. In this manner, the control unit 80 prevents the long paper sheet from having discoloration or deformation.

However, in a case where the previous image forming process is suspended due to a problem such as a jam, or where the long paper sheet is not long enough, the long paper sheet remaining in the conveyance path 50 needs to be removed, and a preparation for printing needs to be conducted to introduce a new long paper sheet. If a preparation for printing is conducted immediately after the long paper sheet is removed, the fixing temperature of the fixing unit 60 might become higher than the predetermined temperature.

Conducting a preparation for printing in such a situation leads to discoloration or deformation of the long paper sheet. Further, while the image forming apparatus 1 is in a standby state after the preparation for printing and before an image is formed, the heat of the fixing unit 60 is absorbed by the long paper sheet, and discoloration or deformation might occur in the long paper sheet.

Furthermore, in a case where the power is back on after it is turned off due to a jam, the system transits to a normal recovery state after the resumption of power, if the system configuration is designed not to store any history of problems. It is assumed that, in such a case, the fixing temperature of the fixing unit 60 is high, and the long paper sheet is left in the fixing unit 60, as described above. If the long paper sheet is a film-type long paper sheet made of polypropylene (PP) or polyethylene terephthalate (PET), the long paper sheet is less resistant to heat than conventional paper. Such a long paper sheet readily deforms or melts, resulting in a problem in the fixing unit 60.

Figure 4:
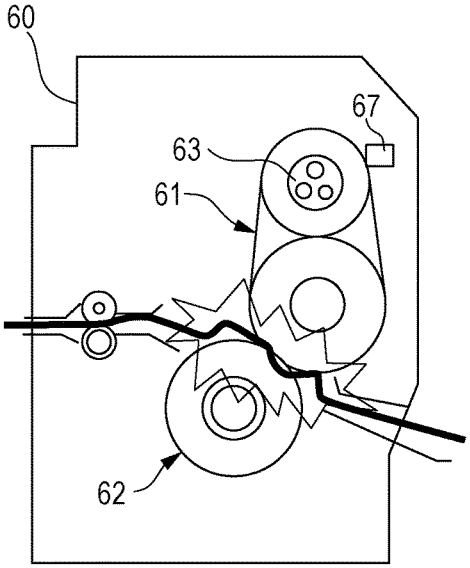
FIG. 4 is a diagram showing an example of a problem caused in a fixing unit.
Figure 5:
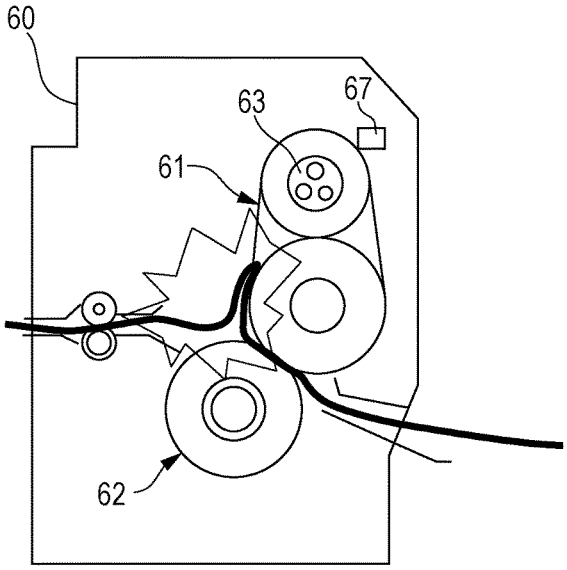
FIG. 5 is a diagram showing another example of a problem caused in the fixing unit.

Referring now to FIGS. 4 and 5, examples of problems that might be caused in the fixing unit 60 are described. FIG. 4 is a diagram showing an example of a problem caused in the fixing unit 60. FIG. 5 is a diagram showing another example of a problem caused in the fixing unit 60.

As shown in FIGS. 4 and 5, a long paper sheet left in the machine, or more specifically, in the fixing unit 60 after the velocity of conveyance of the long paper sheet might cause various kinds of problems. For example, as shown in FIG. 4, the long paper sheet might deform due to transmission of heat from the heating unit 63 to the long paper sheet. Further, as shown in FIG. 5, the long paper sheet might wind around the upper fixing unit 61 in a case where the fixing unit 60 continues to rotate after the long paper sheet deforms due to the heat from the heating unit 63, for example.

Figure 6:
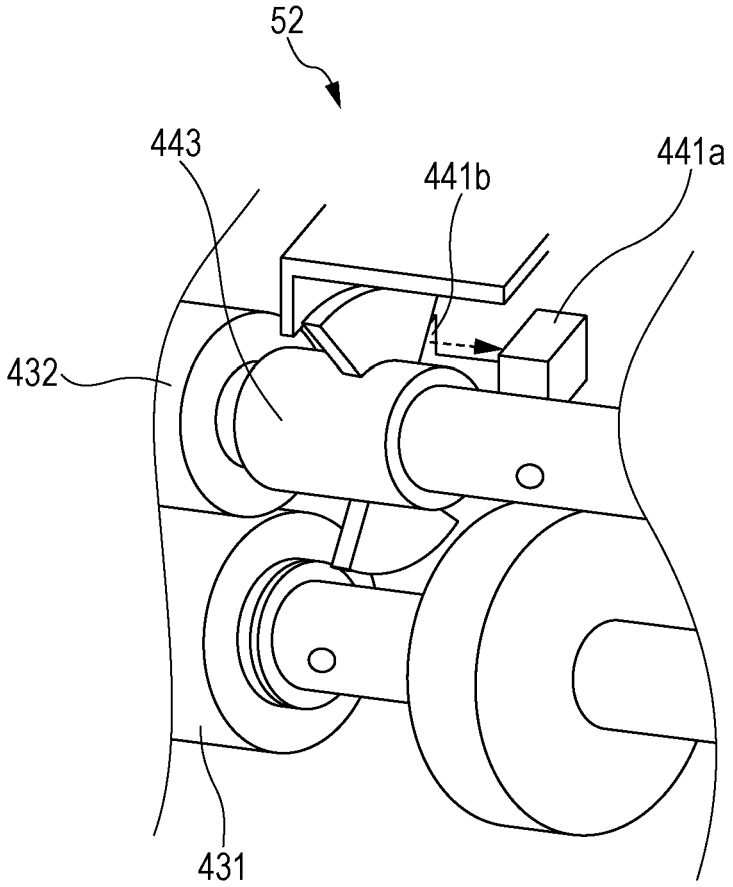
FIG. 6 is a diagram showing a specific example of a paper discharging unit.

Referring now to FIG. 6, an example structure that detects a problem in conveyance of a long paper sheet is described. FIG. 6 is a diagram showing a specific example of the paper discharging unit 52. As shown in FIG. 6, the paper discharging unit 52 includes a driving roller 431, a following roller 432, a velocity sensing unit 441*a*, and a velocity sensing unit 441*b*. The following roller 432 is provided with an encoder 443, and is used for velocity sensing. The velocity sensing unit 441*a* and the velocity sensing unit 441*b* are formed with transmissive photointerrupters. One of the photointerrupters is the light emitting side, and the other is the light receiving side. The velocity sensing unit 441*a* and the velocity sensing unit 441*b* are positioned perpendicularly to the rotating direction of the encoder 443, and sense the encoder 443.

Specifically, when the interval at which the encoder 443 is sensed by the velocity sensing units 441*a* and 441*b* is equal to or shorter than a predetermined interval, the problem determining unit 107 shown in FIG. 3 determines that the conveyance state is normal. If the interval is longer than the predetermined interval, the problem determining unit 107 determines that the conveyance state is abnormal. If the conveyance state is abnormal, the problem determining unit 107 determines that there is a jam inside the machine. The velocity sensing unit 441*a* and the velocity sensing unit 441*b* are also referred to collectively as the velocity sensing unit 441.

Figure 7:
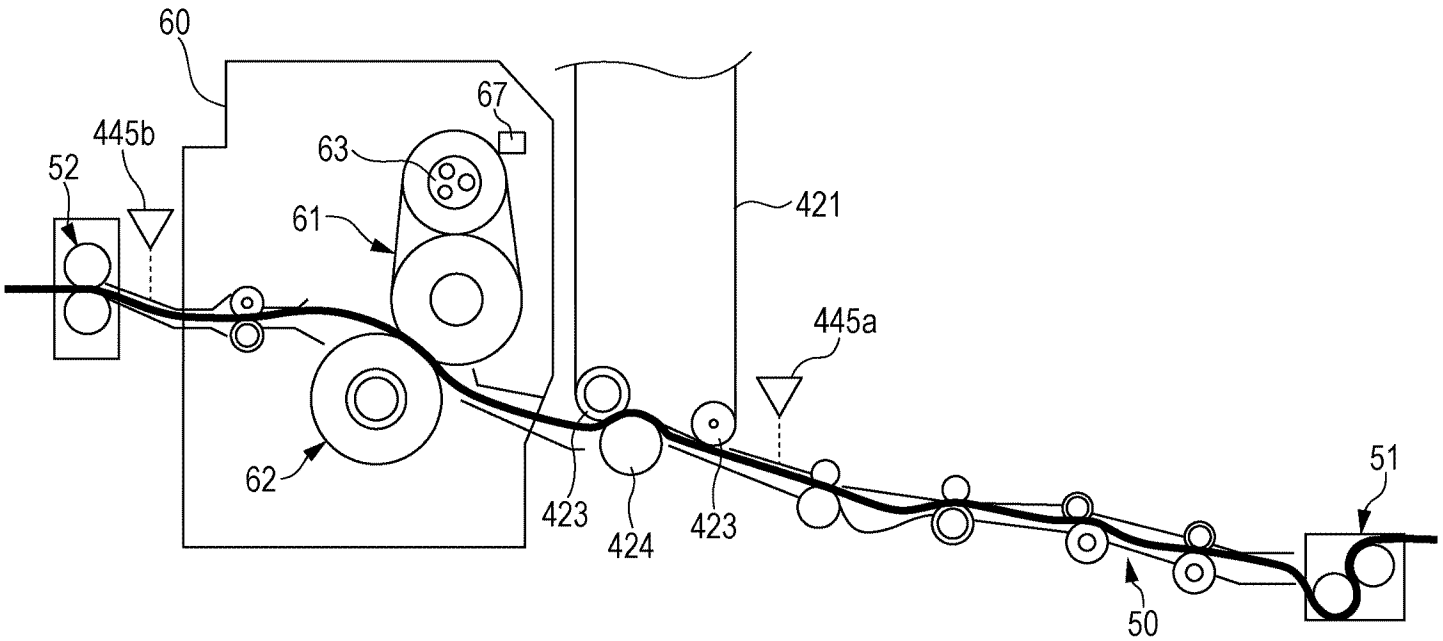
FIG. 7 is a diagram for explaining a state where a long paper sheet exists along a conveyance path extending from a paper feeding unit to the paper discharging unit.
Figure 8:
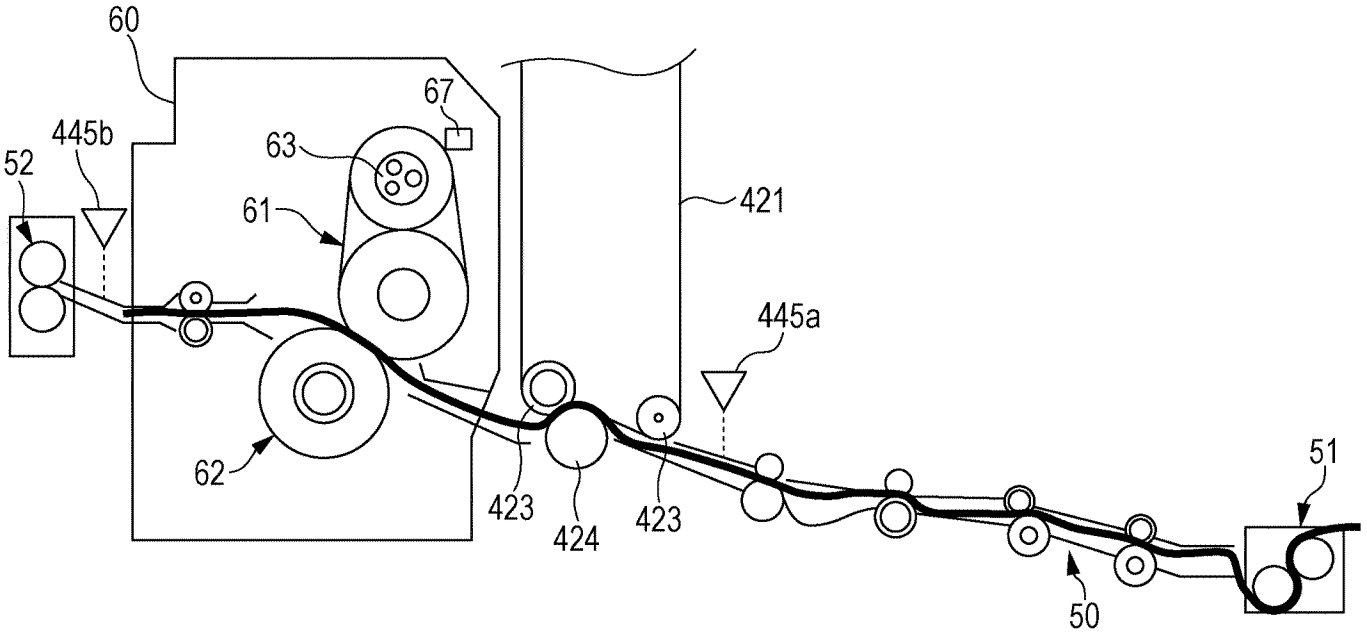
FIG. 8 is a diagram for explaining a state where a long paper sheet exists from the paper feeding unit to the fixing unit.
Figure 9:
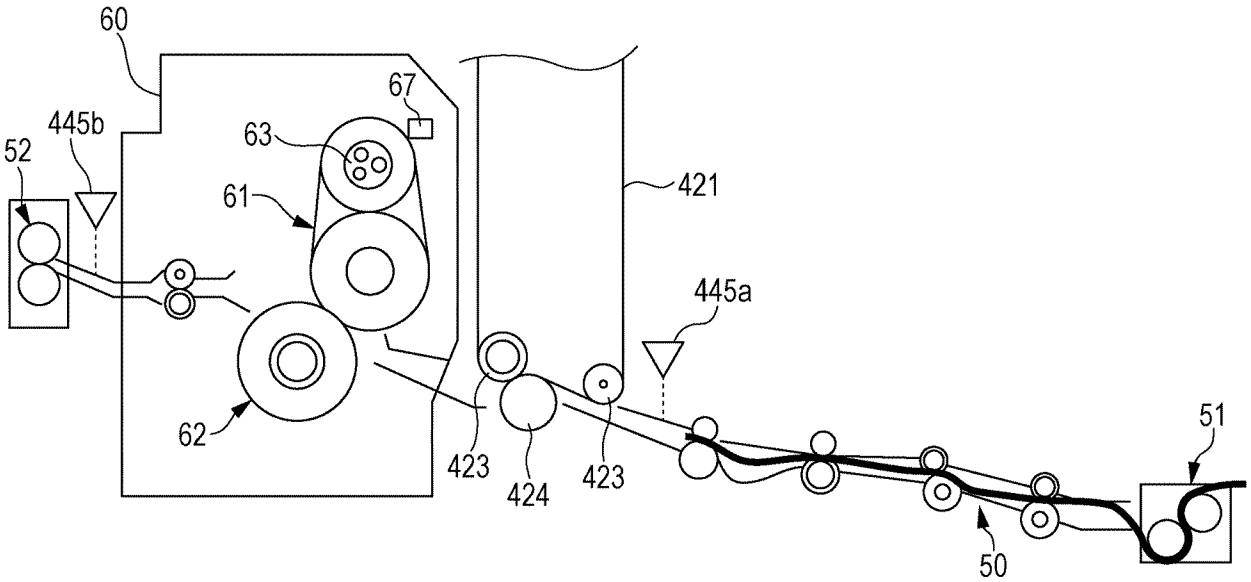
FIG. 9 is a diagram for explaining a state where a long paper sheet exists from the paper feeding unit to a spot immediately before an intermediate transfer belt.

Referring now to FIGS. 7 through 9, the position and the state of a long paper sheet inside the machine are described. FIG. 7 is a diagram for explaining a state where a long paper sheet exists along the conveyance path 50 extending from the paper feeding unit 51 to the paper discharging unit 52. As shown in FIG. 7, a paper sensing unit 445*a* is provided on the upstream side of the intermediate transfer belt 421, and senses an end portion of the long paper sheet being conveyed. A paper sensing unit 445*b* is provided between the fixing unit 60 and the paper discharging unit 52, and senses an end portion of the long paper sheet being conveyed. The paper sensing unit 445*a* and the paper sensing unit 445*b* are also referred to collectively as the paper sensing unit 445.

In FIG. 7, when the power is turned on, the paper sensing unit 445*a* senses the long paper sheet, and the paper sensing unit 445*b* also senses the long paper sheet. That is, when the power is turned on, both the paper sensing unit 445*a* and the paper sensing unit 445*b* sense the long paper sheet. In this case, the long paper sheet is determined to exist along the conveyance path 50 extending from the paper feeding unit 51 to the paper discharging unit 52. That is, the long paper sheet exists from the inlet to the outlet of the printer in a continuous manner. Further, if the fixing temperature of the fixing unit 60 is neither equal to nor lower than a predetermined temperature, or if the fixing temperature is high, an abnormal state is detected and is determined to be a jam.

FIG. 8 is a diagram for explaining a state where a long paper sheet exists from the paper feeding unit 51 to the fixing unit 60. Since the positions of the paper sensing unit 445*a* and the paper sensing unit 445*b* in FIG. 8 are the same as those shown in FIG. 7, explanation of them is not to be repeated herein.

In FIG. 8, when the power is turned on, the paper sensing unit 445*a* senses the long paper sheet, but the paper sensing unit 445*b* does not sense the long paper sheet. That is, when the power is turned on, only the paper sensing unit 445*a* senses the long paper sheet. In this case, the long paper sheet is determined to exist from the paper feeding unit 51 to the fixing unit 60, and an abnormal state is detected and is determined to be a jam. If the fixing temperature of the fixing unit 60 is neither equal to nor lower than the predetermined temperature, or if the fixing temperature is high, the long paper sheet might deform due to heat. In this case, the display unit 21 may display a message to that effect. In the example case illustrated in FIG. 8, the long paper sheet is introduced into the machine, but remains still in the conveyance path 50. Because of this, a jammed state is detected.

FIG. 9 is a diagram for explaining a state where a long paper sheet exists from the paper feeding unit 51 to a spot immediately before the intermediate transfer belt 421. Since the positions of the paper sensing unit 445*a* and the paper sensing unit 445*b* in FIG. 9 are the same as those shown in FIG. 7, explanation of them is not to be repeated herein.

In FIG. 9, when the power is turned on, the paper sensing unit 445*a* does not sense the long paper sheet, and the paper sensing unit 445*b* does not sense the long paper sheet, either. That is, when the power is turned on, neither the paper sensing unit 445*a* nor the paper sensing unit 445*b* senses the long paper sheet. Although the long paper sheet does not exist in the fixing unit 60 in this case, the long paper sheet is determined to exist from the paper feeding unit 51 to the spot immediately before the intermediate transfer belt 421, and an abnormal state is detected and is determined to be a jam.

In a case where any long paper sheet does not exist in the fixing unit 60 while the fixing temperature is high, a long paper sheet introduced into the machine might deform due to heat. In such a case, a message to the effect that any long paper sheet is not to be introduced into the machine may be displayed until the fixing temperature becomes equal to or lower than the predetermined temperature.

In the example case illustrated in FIG. 9, the long paper sheet is introduced into the machine, but remains still in the conveyance path 50. Because of this, a jammed state is detected.

Figure 10:
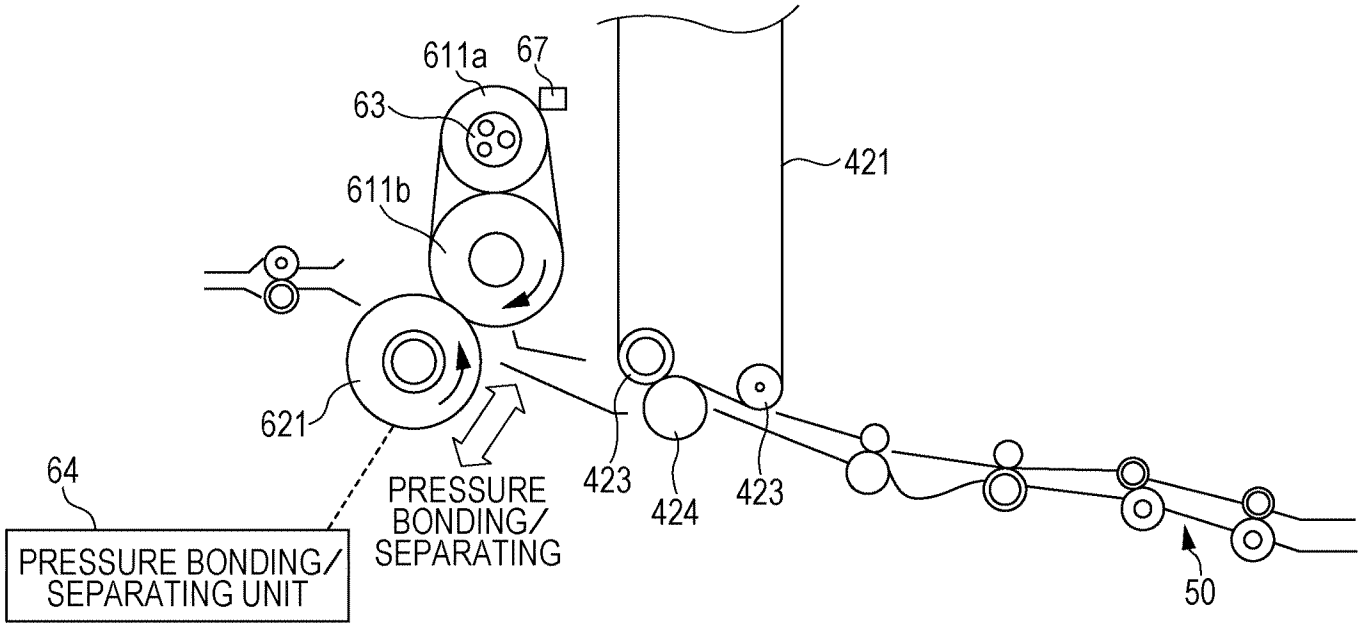
FIG. 10 is a diagram for explaining a specific example of the fixing unit.

Referring now to FIG. 10, a pressure-bonding operation and a separating operation to be performed by the fixing unit 60 are described. FIG. 10 is a diagram for explaining a specific example of the fixing unit 60.

In a case where the fixing operation of the fixing unit 60 is disabled when the power is turned on, and the fixing roller 611*b* and the pressure roller 621 are determined to be in a pressure-bonded state, the pressure bonding/separating unit 64 separates the pressure roller 621 from the fixing roller 611*b*. As a result, the fixing roller 611*b* and the pressure roller 621 are put into a separated state.

In a case where the fixing operation of the fixing unit 60 is enabled when the power is turned on, and the fixing roller 611*b* and the pressure roller 621 are determined to be in a pressure-bonded state, on the other hand, the pressure bonding/separating unit 64 maintains the current position of the pressure roller 621. In a case where the fixing operation of the fixing unit 60 is enabled when the power is turned on, and the fixing roller 611*b* and the pressure roller 621 are determined to be in a separated state, the pressure bonding/separating unit 64 brings the pressure roller 621 into the position of a pressure-bonded state.

Figure 11:
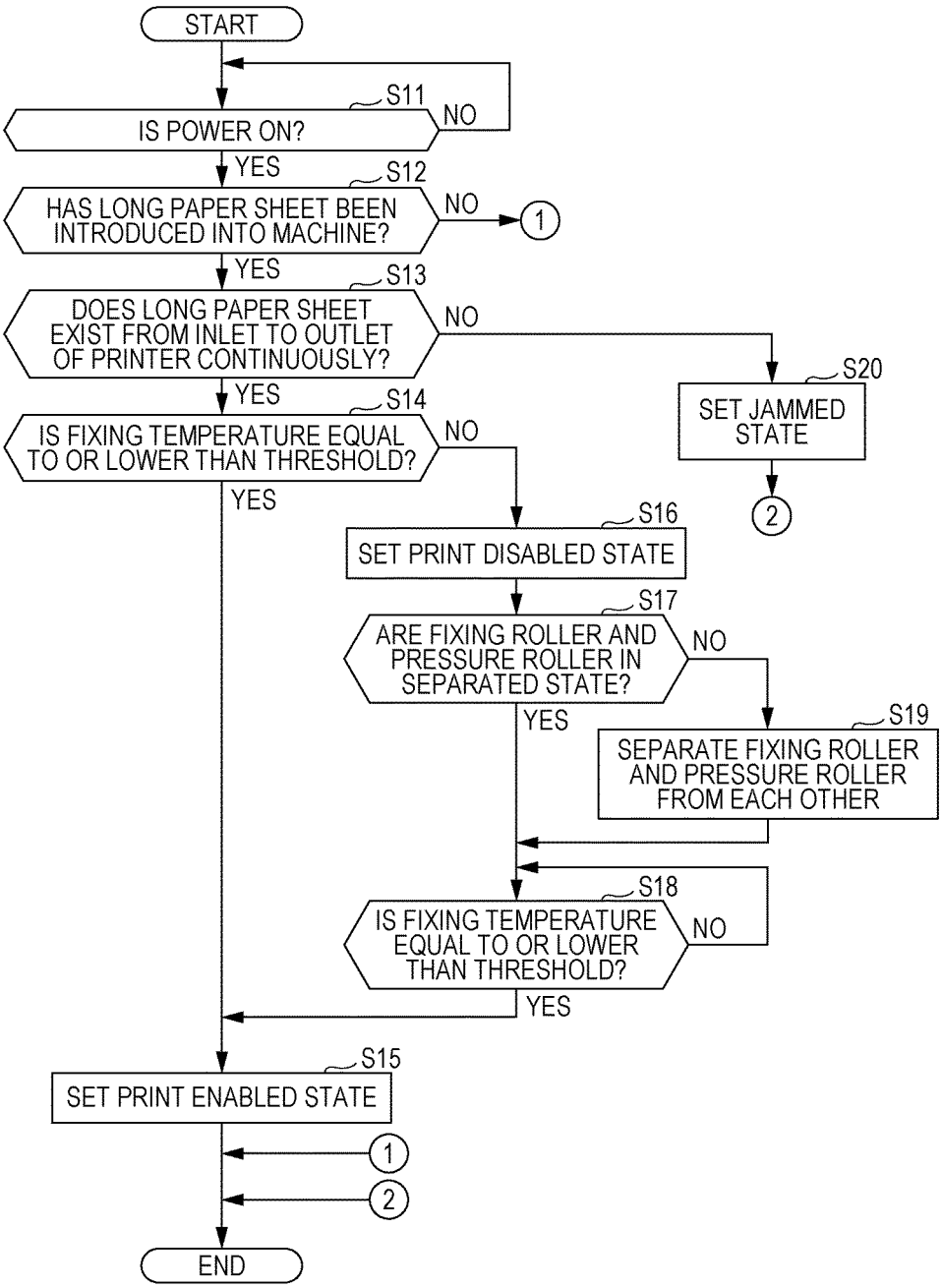
FIG. 11 is a flowchart for explaining an example operation of the image forming apparatus.

Referring now to FIG. 11, an example operation to be performed to determine whether to perform printing based on the fixing temperature after the power is turned on is described. FIG. 11 is a flowchart for explaining an example operation of the image forming apparatus 1.

In step S11, the paper existence determining unit 101 determines whether the power has been turned on. If the paper existence determining unit 101 determines that the power has been turned on, the operation moves on to step S12. If the paper existence determining unit 101 determines that the power has not been turned on, the operation remains in the standby state.

In step S12, the paper existence determining unit 101 determines whether a long paper sheet has been introduced into the machine based on a result of sensing performed by the paper sensing unit 445. If the paper existence determining unit 101 determines that a long paper sheet has been introduced into the machine, the operation moves on to step S13. If the paper existence determining unit 101 determines that any long paper sheet does not exist in the machine, the operation comes to an end.

That is, step S12 is carried out to roughly check the position and the state of a long paper sheet inside the machine.

In step S13, the paper existence determining unit 101 determines whether the long paper sheet exists from the inlet to the outlet of the printer in a continuous manner. If the paper existence determining unit 101 determines that the long paper sheet exists from the inlet to the outlet of the printer in a continuous manner, the operation moves on to step S14. If the paper existence determining unit 101 determines that the long paper sheet does not exist from the inlet to the outlet of the printer in a continuous manner, the operation moves on to step S20.

That is, step S13 is carried out to closely check the position and the state of the long paper sheet inside the machine.

In step S14, the temperature determining unit 102 determines whether the fixing temperature of the fixing unit 60 is equal to or lower than a threshold, or is equal to or lower than a predetermined temperature, based on a result of sensing performed by the temperature sensing unit 67. If the fixing temperature is determined to be equal to or lower than the threshold, the operation moves on to step S15. If the fixing temperature is determined not to be equal to or lower than the threshold, the operation moves on to step S16.

In step S15, the state setting unit 103 sets a print enabled state, and the operation then comes to an end. In a case where a print enabled state is set, the display control unit 105 may cause the display unit 21 to display a message to that effect.

In step S16, the state setting unit 103 sets a print disabled state, and the operation then moves on to step S17. In a case where a print disabled state is set, the display control unit 105 may cause the display unit 21 to display a message to that effect.

In step S17, the state determining unit 104 determines whether the fixing roller 611*b* and the pressure roller 621 are in a separated state. Specifically, the state determining unit 104 determines whether the fixing roller 611*b* and the pressure roller 621 are in a separated state, and whether the fixing roller 611*b* and the pressure roller 621 are in a pressure-bonded state.

If the fixing roller 611*b* and the pressure roller 621 are determined to be in a separated state, the operation moves on to step S18. If the fixing roller 611*b* and the pressure roller 621 are determined not to be in a separated state, or if the fixing roller 611*b* and the pressure roller 621 are in a pressure-bonded state, the operation moves on to step S19.

In step S18, the temperature determining unit 102 determines whether the fixing temperature of the fixing unit 60 is equal to or lower than the threshold, or is equal to or lower than the predetermined temperature, based on a result of sensing performed by the temperature sensing unit 67. If the fixing temperature is determined to be equal to or lower than the threshold, the operation moves on to step S15.

If the fixing temperature is determined not to be equal to or lower than the threshold, the operation returns to step S18. Specifically, the fixing roller 611*b* and the pressure roller 621 remain in the separated state, and the operation remains in a standby state until the fixing temperature becomes equal to or lower than the predetermined temperature.

In step S19, the pressure bonding/separating unit 64 separates the fixing roller 611*b* and the pressure roller 621 from each other, and the operation moves on to step S18.

In step S20, the state determining unit 104 sets a jammed state, and the operation then comes to an end. In a case where a jammed state is set, the display control unit 105 may cause the display unit 21 to display a message to that effect.

As described above, in a case where a long paper sheet such as roll paper or continuous paper exists along the conveyance path 50 extending from the paper feeding side to the paper discharging side or where a long paper sheet exists in the machine when the power is turned on, the image forming apparatus 1 determines whether to allow rotation for fixing in accordance with the fixing temperature of the fixing unit 60.

Specifically, in a case where a long paper sheet exists from the inlet to the outlet of the printer in a continuous manner, the image forming apparatus 1 determines the fixing temperature of the fixing unit 60. If the fixing temperature of the fixing unit 60 is determined not to be equal to or lower than a predetermined temperature, the image forming apparatus 1 disables the fixing operation of the fixing unit 60.

As described above, if the fixing temperature of the fixing unit 60 is higher than the predetermined temperature, the image forming apparatus 1 prohibits the rotation for fixing. In this manner, the image forming apparatus 1 can control operation of the fixing unit 60 in accordance with the position and the state of the long paper sheet, and the fixing temperature of the fixing unit 60.

In other words, in a case where a long paper sheet exists inside the machine, and the fixing temperature of the fixing unit 60 is determined not to be equal to or lower than the predetermined temperature, the image forming apparatus 1 disables the fixing operation of the fixing unit 60. By doing so, the image forming apparatus 1 controls operation of the fixing unit 60 in accordance with the positions and the state of the long paper sheet, and the fixing temperature of the fixing unit 60. Thus, the image forming apparatus 1 can determine whether to perform printing in accordance with the conditions inside the machine.

In a case where a long paper sheet exists inside the machine, and the fixing temperature of the fixing unit 60 is determined not to be equal to or lower than the predetermined temperature, the image forming apparatus 1 also displays a message to the effect that the long paper sheet should be removed from the conveyance path 50.

That is, in a case where a long paper sheet exists inside the machine, the image forming apparatus 1 reports that the long paper sheet should be removed in accordance with the fixing temperature of the fixing unit 60.

Regardless of whether the fixing roller 611*b* and the pressure roller 621 are in a separated state or are in a pressure-bonded state, the image forming apparatus 1 displays a message to the effect that the long paper sheet should be removed in accordance with the fixing temperature of the fixing unit 60. By doing so, the image forming apparatus 1 can prompt the user to remove the long paper sheet. As a result, the possibility of overlooking heating of a long paper sheet is lowered, and a problem due to an increase in the temperature of the fixing unit 60 can be avoided.

In a case where a long paper sheet exists inside the machine, and the fixing temperature of the fixing unit 60 is determined not to be equal to or lower than the predetermined temperature, the image forming apparatus 1 also separates the pressure roller 621 from the fixing roller 611*b* if the fixing roller 611*b* and the pressure roller 621 are in a pressure-bonded state.

That is, the image forming apparatus 1 separates the pressure roller 621 from the fixing roller 611*b* in a case where a long paper sheet exists inside the machine, the fixing temperature of the fixing unit 60 is higher than the predetermined temperature, the fixing operation of the fixing unit 60 is disabled, and the fixing roller 611*b* and the pressure roller 621 are in a pressure-bonded state.

In this manner, the image forming apparatus 1 prevents the long paper sheet from coming into contact with the fixing roller 611*b* and the pressure roller 621. By doing so, the image forming apparatus 1 prevents the heat of the fixing unit 60 from propagating to the long paper sheet. Thus, the image forming apparatus 1 can prevent the long paper sheet from deforming and melting with heat, even if the long paper sheet is of a film type.

If the fixing temperature of the fixing unit 60 is determined to be equal to or lower than the predetermined temperature, the image forming apparatus 1 enables the fixing operation of the fixing unit 60.

If the amount of heat propagating to the long paper sheet is small, any problem occurs due to a high temperature of the fixing unit 60, and a print enabled state can be set. In this manner, a print enabled state is set in accordance with the conditions inside the machine. Thus, the image forming apparatus 1 can transit from an abnormal suspension state to a normal recovery state at an appropriate time.

In a case where the velocity of conveyance of the long paper sheet is equal to or lower than a predetermined velocity when the long paper sheet is conveyed, the image forming apparatus 1 determines that the long paper sheet remains abnormally still in the conveyance path 50. That is, when the velocity of conveyance of the long paper sheet drops, the image forming apparatus 1 determines that a jam has occurred.

Where the velocity of conveyance of the long paper sheet drops, the conveyance might have become difficult because the long paper sheet has deformed or wound around a roller in the conveyance path 50, for example. In such situations, the conveyance of the long paper sheet will stop eventually. To avoid that, the velocity of conveyance of the long paper sheet is compared with a predetermined velocity, and a check is made to determine whether the long paper sheet remains abnormally still in the conveyance path 50. In this manner, abnormal conveyance of the long paper sheet can be detected. The velocity of conveyance of the long paper sheet can be sensed by a simple structure formed with the encoder 443 and transmissive photointerrupters. In this manner, a check is made to determine whether the long paper sheet remains abnormally still in the conveyance path 50 in accordance with the velocity of conveyance of the long paper sheet. Thus, abnormal conveyance of the long paper sheet can be detected with a simple structure.

The image forming apparatus 1 also changes the predetermined temperature in accordance with the type of the long paper sheet. That is, the image forming apparatus 1 can take into account the type of the long paper sheet when comparing the fixing temperature of the fixing unit 60 with the predetermined temperature. In the case of a film-type long paper sheet, for example, the predetermined temperature is made lower than that for regular long paper sheets, so that deformation or the like of the long paper sheet due to heat can be avoided.

As described above, the fixing temperature of the fixing unit 60 is determined by taking into account the type of the long paper sheet, so that printing can be allowed or prohibited in accordance with the type of the long paper sheet. Thus, the conditions inside the machine after the power is turned on can be accurately managed.

As described above, the image forming apparatus 1 according to this embodiment forms an image on a long paper sheet conveyed along the conveyance path 50 extending from the paper feeding side to the paper discharging side. The image forming apparatus 1 includes: the image forming unit 40 that transfers a toner image onto the long paper sheet; the fixing unit 60 that fixes the toner image transferred by the image forming unit 40 onto the long paper sheet; the paper existence determining unit 101 that determines whether the long paper sheet exists along the conveyance path 50 when power is turned on; the temperature determining unit 102 that determines whether the fixing temperature of the fixing unit 60 is equal to or lower than a predetermined temperature when the paper existence determining unit 101 determines that the long paper sheet exists along the conveyance path 50; and the state setting unit 103 that disables the fixing operation of the fixing unit 60 when the temperature determining unit 102 determines that the fixing temperature is higher than the predetermined temperature.

With this structure, the operation of the fixing unit 60 is controlled in accordance with the position and the state of the long paper sheet, and the fixing temperature of the fixing unit 60. Thus, printing can be allowed or prohibited in accordance with the conditions inside the machine.

The image forming apparatus 1 according to this embodiment further includes: the display unit 21; and the display control unit 105 that controls the display unit 21. In this image forming apparatus 1, when the temperature determining unit 102 determines that the fixing temperature is higher than the predetermined temperature, the display control unit 105 causes the display unit 21 to display a message to the effect that the long paper sheet should be removed from the conveyance path 50.

With this structure, the possibility of overlooking heating of the long paper sheet is lowered, and a problem due to an increase in the temperature of the fixing unit 60 can be avoided.

In the image forming apparatus 1 according to this embodiment, the fixing unit 60 includes the fixing roller 611*b* and the pressure roller 621. This image forming apparatus 1 further includes: the state determining unit 104 that determines whether the fixing roller 611*b* and the pressure roller 621 are in a separated state, and whether the fixing roller 611*b* and the pressure roller 621 are in a pressure-bonded state, when the state setting unit 103 disables the fixing operation of the fixing unit 60; and the pressure bonding/separating unit 64 that separates the pressure roller 621 from the fixing roller 611*b* when the state determining unit 104 determines that the fixing roller 611*b* and the pressure roller 621 are in the pressure-bonded state.

With this structure, the long paper sheet is not brought into contact with the fixing roller 611*b* and the pressure roller 621. Thus, the long paper sheet can be prevented from deforming and melting with heat, even if the long paper sheet is of a film type.

In the image forming apparatus 1 according to this embodiment, when the temperature determining unit 102 determines that the fixing temperature is equal to or lower than the predetermined temperature, the state setting unit 103 enables the fixing operation of the fixing unit 60.

With this structure, a print enabled state is set in accordance with the conditions inside the machine. Thus, the image forming apparatus 1 can transit from an abnormal suspension state to a normal recovery state at an appropriate time.

The image forming apparatus 1 according to this embodiment further includes: the conveyance control unit 106 that controls conveyance of the long paper sheet; the velocity sensing unit 441 that senses the velocity of conveyance of the long paper sheet being conveyed under the control of the conveyance control unit 106; and the problem determining unit 107 that determines that the long paper sheet remains abnormally still in the conveyance path 50 when the conveyance velocity sensed by the velocity sensing unit 441 is equal to or lower than a predetermined velocity while the long paper sheet is being conveyed under the control of the conveyance control unit 106.

With this structure, a check is made to determine whether the long paper sheet remains abnormally still in the conveyance path 50 in accordance with the velocity of conveyance of the long paper sheet. Thus, abnormal conveyance of the long paper sheet can be detected with a simple structure.

The image forming apparatus 1 according to this embodiment further includes the temperature changing unit 108 that changes the predetermined temperature in accordance with the paper type of the long paper sheet.

With this structure, the fixing temperature of the fixing unit 60 is determined by taking into account the type of the long paper sheet, so that printing can be allowed or prohibited in accordance with the type of the long paper sheet. Thus, the conditions inside the machine after the power is turned on can be accurately managed.

Although the image forming apparatus 1 according to an embodiment of the present invention has been described so far, the present invention is not limited to the embodiment, and modifications may be made to it without departing from the scope of the invention.

For example, the velocity sensing unit 441 described above is formed with transmissive photointerrupters. However, the velocity sensing unit 441 is not limited to them, and may be formed with reflective photosensors, rotary encoders, or Hall elements.

Further, in the above described example, the velocity sensing unit 441 determines whether there is a jam. However, a check may be made to determine whether there is a jam in accordance with the period of long paper sheet conveyance from the time when the paper sensing unit 445*a* senses the long paper sheet until the time when the paper sensing unit 445*b* senses the long paper sheet.

Although the image forming apparatus 1 is designed to perform full-color printing in this embodiment, the image forming apparatus 1 may be designed to perform monochrome printing.

In the above described example, the paper sensing unit 445*a* is provided on the upstream side of the intermediate transfer belt 421. However, the paper sensing unit 445*a* is not limited to that arrangement, but should be provided on the upstream side of the fixing unit 60.

Further, in the above described example, the paper sensing unit 445*b* is provided between the fixing unit 60 and the paper discharging unit 52. However, the paper sensing unit 445*b* is not limited to that arrangement, but should be provided on the downstream side of the fixing unit 60.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus that forms an image on a long paper sheet conveyed along a conveyance path extending from a paper feeding side to a paper discharging side, the image forming apparatus comprising:

an image forming unit configured to transfer a toner image onto the long paper sheet;

a fixing unit configured to fix the toner image transferred by the image forming unit onto the long paper sheet;

a paper existence determining unit configured to determine whether the long paper sheet exists in the fixing unit when power is turned on;

a temperature determining unit configured to determine whether a temperature of the fixing unit is equal to or lower than a predetermined temperature; and a state setting unit configured to disable a fixing operation of the fixing unit when the paper existence determining unit determines that the long paper sheet exists in the fixing unit when power is turned on and the temperature determining unit determines that the temperature of the fixing unit is higher than the predetermined temperature.

2. The image forming apparatus according to claim 1, further comprising:

a display unit; and a display control unit configured to control the display unit, wherein, when the temperature determining unit determines that the temperature of the fixing unit is higher than the predetermined temperature, the display control unit causes the display unit to indicate that the long paper sheet is to be removed from the conveyance path.

3. The image forming apparatus according to claim 2, wherein:

the fixing unit includes a fixing roller and a pressure roller; and the image forming apparatus further comprises:

a state determining unit configured to determine whether the fixing roller and the pressure roller are in a separated state, and whether the fixing roller and the pressure roller are in a pressure-bonded state, when the state setting unit disables the fixing operation of the fixing unit; and a pressure bonding/separating unit configured to separate the pressure roller from the fixing roller when the state determining unit determines that the fixing roller and the pressure roller are in the pressure-bonded state.

4. The image forming apparatus according to claim 3, wherein, when the temperature determining unit determines that the temperature of the fixing unit is equal to or lower than the predetermined temperature, the state setting unit enables the fixing operation of the fixing unit.

5. The image forming apparatus according to claim 1, further comprising:

a conveyance control unit configured to control conveyance of the long paper sheet;

a velocity sensing unit configured to sense a velocity of conveyance of the long paper sheet being conveyed under the control of the conveyance control unit; and a problem determining unit configured to determine that the long paper sheet remains abnormally still in the conveyance path when the conveyance velocity sensed by the velocity sensing unit is equal to or lower than a predetermined velocity while the long paper sheet is being conveyed under the control of the conveyance control unit.

6. The image forming apparatus according to claim 1, further comprising a temperature changing unit configured to change the predetermined temperature in accordance with a paper type of the long paper sheet.

7. The image forming apparatus according to claim 1, wherein the predetermined temperature is lower than a fixing temperature of the fixing unit during normal use.

8. The image forming apparatus according to claim 2, wherein:

the fixing unit includes a fixing roller and a pressure roller; and the image forming apparatus further comprises:

a state determining unit configured to determine whether the fixing roller and the pressure roller are in a separated state, and whether the fixing roller and the pressure roller are in a pressure-bonded state, when the state setting unit disables the fixing operation of the fixing unit; and a pressure bonding/separating unit configured to separate the pressure roller from the fixing roller when the state determining unit determines that the fixing roller and the pressure roller are in the pressure-bonded state.

9. The image forming apparatus according to claim 3, wherein, when the temperature determining unit determines that the temperature of the fixing unit is equal to or lower than the predetermined temperature, the state setting unit enables the fixing operation of the fixing unit.

* * * * *